US009620881B1

(12) United States Patent
Yang

(10) Patent No.: US 9,620,881 B1
(45) Date of Patent: Apr. 11, 2017

(54) ELECTRICAL CONNECTOR AND DRILLING SYSTEM

(71) Applicant: Beijing Hailan Science & Technology Development Co., Ltd., Beijing (CN)

(72) Inventor: Biao Yang, Beijing (CN)

(73) Assignee: BEIJING HAILAN SCIENCE & TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 15/078,696

(22) Filed: Mar. 23, 2016

(51) Int. Cl.
*H01R 13/05* (2006.01)
*H01R 13/187* (2006.01)
*H01R 13/405* (2006.01)
*E21B 17/02* (2006.01)

(52) U.S. Cl.
CPC ..... *H01R 13/187* (2013.01); *E21B 17/028* (2013.01); *H01R 13/405* (2013.01)

(58) Field of Classification Search
CPC ..... H01R 13/17
USPC ..... 439/825, 827, 840, 843
See application file for complete search history.

(56) References Cited

U.S. PATENT DOCUMENTS 3,019,410 A * 1/1962 Logan ..... H01R 13/025 439/848
3,766,516 A * 10/1973 Appleton ..... H01R 13/15 439/825
4,087,152 A * 5/1978 Kolm ..... H01R 13/33 439/827
4,944,701 A * 7/1990 Spinner ..... H01R 24/40 439/825
5,174,777 A * 12/1992 Carter ..... H01R 23/27 439/290
5,904,599 A * 5/1999 Miller ..... H01R 13/17 439/825
6,010,369 A * 1/2000 Itabashi ..... H01R 13/025 439/660
6,074,236 A * 6/2000 Wu ..... H01R 13/631 439/378

* cited by examiner

*Primary Examiner* — Neil Abrams
(74) *Attorney, Agent, or Firm* — K&L Gates LLP

(57) ABSTRACT

The present invention provides an electrical connector comprising a socket and a plug. A jack is set on the socket, and a socket pin is set in the jack. The plug is set with a plug pin that has a one-to-one correspondence with the socket pin. The plug has an insertion part that is in insertion fit with the jack, and the end part of the insertion part is set with a first groove that extends along its insertion direction. The plug pin has a one-to-one correspondence with the first groove, and has an exposed part that is exposed in the first groove. The electrical connector further comprises a first compression spring, which has a one-to-one correspondence with the first groove. The two ends of the first compression spring respectively abut against the inner wall of the two ends of the first groove. The first compression spring is detachably mounted on and contact the exposed part in the corresponding first groove. The socket pin contacts the corresponding first compression spring as the jack becomes in insertion fit with the insertion part of the plug. The invention further provides a drilling system. The solution of the present invention can solve the problem of the prior art that the operation is complex and the cost is high when the connection stability of the electrical connector is ensured by way of replacing pins.

10 Claims, 3 Drawing Sheets

ELECTRICAL CONNECTOR AND DRILLING SYSTEM

FIELD OF THE INVENTION

The present invention relates to the technical field of electrical connecting devices, and in particular, to an electrical connector and a drilling system.

BACKGROUND OF THE INVENTION

During petroleum drilling, as the drill rod of a drilling device strikes into the earth gradually, a petroleum instrument (for example, inclinometer) set in the chamber of the drill rod will transmit the detected data to the ground successively, thereby the subsequent analyzing and processing on the detected data may be realized by a ground device. During this process, the petroleum instrument usually realizes the communication connection with the ground device via an electrical connector, thereby the transmission of the detected data may be realized. The electrical connector includes a plug and a socket that fits the plug. One of the plug and the socket is connected to the cable of the petroleum instrument, and the other is connected to the cable of the ground device that strikes into the drilling well. The fitting between the plug and the socket realizes the communication connection between the petroleum instrument and the ground device.

At present, the plug and the socket of an electrical connector has a pin-fit structure, a projective pin is set on the plug, a jack is set at the fitting part between the socket and the plug, metallic powder (for example, gold powder and silver powder) is usually coated on the pin, and after the jack and the pin are in insertion fit with each other, the inner wall of the jack joints with the outer surface of the pin, thereby realizing the connection of the circuit. As is known, during drilling, the drilling device vibrates sharply, which will usually drive the electrical connector to vibrate together, thereby it will cause the pin to drift in the jack, thus abrasion will be caused. As is known, the friction on the outer surface of the pin will make the pin thinner and thinner, and finally, it will cause the pin and the jack unable to fit with each other, as a result, the line connection will be unstable, or even open circuit will occur. At the same time, the friction between the outer surface of the pin and the inner surface of the jack will cause the metallic powder on the surface of the pin to fall, which causes the line connection to be further unstable. During the construction of the invention, the inventors find that, besides the petroleum drilling field, all electrical connectors have the above problem when operating in a vibration environment.

In order to solve the above problem of unstable line connection, at present, a way of replacing pins is usually employed. Generally, a pin is set on a plug via ceramic injection moulding. During replacement, it requires to separate the pin from the basal body of the plug and then injection-mould a new pin on the basal body of the plug. For the above mode of replacing pins, the operation is complex, and the replacement cost is high due to the complex operation process.

Therefore, it becomes an urgent technical problem to be solved by those skilled in the art how to solve the problem of the prior art that the operation is complex and the cost is high when the connection stability of the electrical connector is ensured by way of replacing pins.

SUMMARY OF THE INVENTION

The invention provides an electrical connector, thereby solving the problem of the prior art that the operation is complex and the cost is high when the connection stability of the electrical connector is ensured by way of replacing pins.

In order to the above technical problem, the invention provides the following technical solutions:

An electrical connector, which includes a socket and a plug; a jack is set on the socket, and a socket pin is set in the jack; the plug is set with a plug pin that has a one-to-one correspondence with the socket pin; the plug has an insertion part that is in insertion fit with the jack, and the end part of the insertion part is set with a first groove that extends along its insertion direction; the plug pin has a one-to-one correspondence with the first groove and has an exposed part that is exposed in the first groove; the electrical connector further includes a first compression spring, which has a one-to-one correspondence with the first groove, and the two ends of the first compression spring respectively abut against the inner wall of the two ends of the first groove; the first compression spring is detachably mounted on and contacts the exposed part in the corresponding first groove; the socket pin contacts the corresponding first compression spring as the jack becomes in insertion fit with the insertion part of the plug.

Preferably, in the above electrical connector, the exposed part is a bar-shaped body with a circular cross section, and the bar-shaped body at least extends over the midpoint of the first groove in the length direction, and the first compression spring is sleeved on the bar-shaped body.

Preferably, in the above electrical connector, the exposed part includes a locating part and a supporting part, the first compression spring is sleeved on the locating part, and the supporting part and the locating part have a one-piece structure and are located between the first compression spring and the groove base of the first groove.

Preferably, in the above electrical connector, the exposed part is a first supporting plate that extends along the length direction of the first groove, and the first compression spring is sleeved on the first supporting plate;

The socket has a second groove that has a one-to-one correspondence with the first groove, and the socket pin includes a second supporting plate that extends along the length direction of the second groove and a second compression spring that is sleeved on the second supporting plate; the second compression spring is adapted to contact the corresponding first compression spring as the jack becomes in insertion fit with the insertion part of the plug.

Preferably, in the above electrical connector, the plug pin is buried in the plug, and the part that is connected with the exposed part is a thickened section, of which the diameter is greater than that of the exposed part.

Preferably, in the above electrical connector, the insertion part is set with a half-opened groove that extends the insertion direction, the groove opening of the half-opened groove is located on the insertion end of the insertion part, and the end part of the insertion part is set with a screw, the insertion part of the screw is in thread fit with the insertion part, and the screw cap of the screw is fit with the groove opening in the manner of blocking the groove opening to form the first groove.

Preferably, in the above electrical connector, the insertion part is a hexagonal prism or an octagonal prism, of which each prismatic plane is set with the first groove.

Preferably, in the above electrical connector, the area of each prismatic plane of the insertion part is not equal to each other, and the area of the inner wall of the jack corresponding to each prismatic plane of the insertion part is not equal to each other.

Preferably, in the above electrical connector, the socket pin is set on the socket via ceramic injection moulding, the plug pin is set on the plug via ceramic injection moulding, and the part of the socket pin that is buried in the socket and the part of the plug pin that is buried in the plug both have multiple sections of threads that are isolated from each other.

Based on the electrical connector of the invention, the invention further provides a drilling system, which has any one of the above electrical connectors.

During the assembling of the electrical connector of the invention, the first compression spring is mounted, in a one-to-one correspondence, on the exposed part of the plug pin that is located in the first groove, and the two ends of the first compression spring respectively abut against the inner wall of the two ends of the first groove, thus the first compression spring will be in a compressed state. The insertion part of the plug is inserted into the jack of the socket, and the socket pin contacts the corresponding first compression spring as the insertion part of the plug becomes in insertion fit with the jack. Because the socket pin has a one-to-one correspondence with the plug pin, and the first compression spring has a one-to-one correspondence with and contacts the plug pin, the socket pin contacts the corresponding first compression spring as the insertion part of the plug becomes in insertion fit with the jack, thereby the socket pin can be indirectly connected with the corresponding plug pin via the first compression spring.

It may be known from the above description that, the socket pin and the plug pin are electrically connected via the first compression spring, and when the first compression spring is abrased seriously, it may be directly removed from the exposed part and then replaced, thus the operation is simple. Of course, during the whole replacement process, no additional process (for example, soldering) is required, and it does not need to replace the whole plug pin, thus the cost can be lowered.

BRIEF DESCRIPTION OF THE DRAWINGS

In order to more clearly illustrate the technical solutions of the embodiments of the invention, the drawings needed in the description of the embodiments will be briefly introduced below. Apparently, the drawings in the description below are only some embodiments of the invention, and other drawings may also be obtained by one of ordinary skills in the art according to these drawings without creative work.

In the above FIG. 1-FIG. 8:

Plug 11, Socket 12, Screw 13, First Compression Spring 14, Plug Pin 111, Plug Ceramic Basal Body 112, Insertion Part 113, Bar-Shaped Body 1111, Locating Part 1112, Supporting Part 1113, First Supporting Plate 1114, Thickened Section 1115, First Groove 1131, Screw Cap 131, Socket Ceramic Basal Body 121, Socket Pin 122, Jack 123, Second Groove 124, Second Supporting Plate 125, Second Compression Spring 126.

DETAILED DESCRIPTION OF THE EMBODIMENTS

The embodiments of the invention provide an electrical connector, thereby solving the problem of the prior art that the operation is complex and the cost is high when the connection stability of the electrical connector is ensured by way of replacing pins.

In order to make one skilled in the art better understand the technical solutions in the embodiments of the invention and to make the above objects, characteristics and advantages of the embodiments of the invention more apparent, the technical solutions in the embodiments of the invention will be further illustrated in detail below in conjunction with the drawings.

Figure 1:
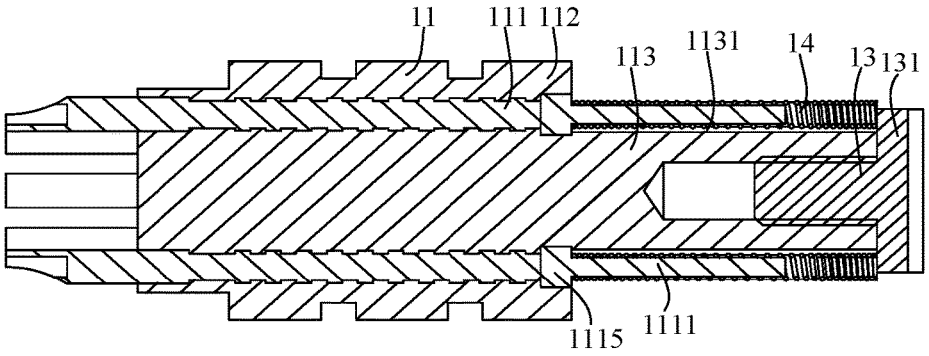
FIG. 1 is a structural representation of a plug according to one embodiment of the invention.
Figure 2:
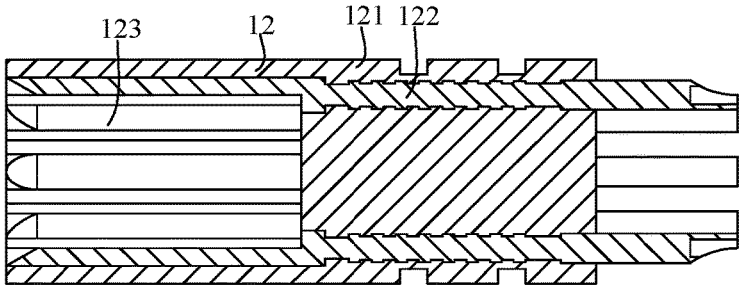
FIG. 2 is a structural representation of a socket according to one embodiment of the invention.
Figure 3:
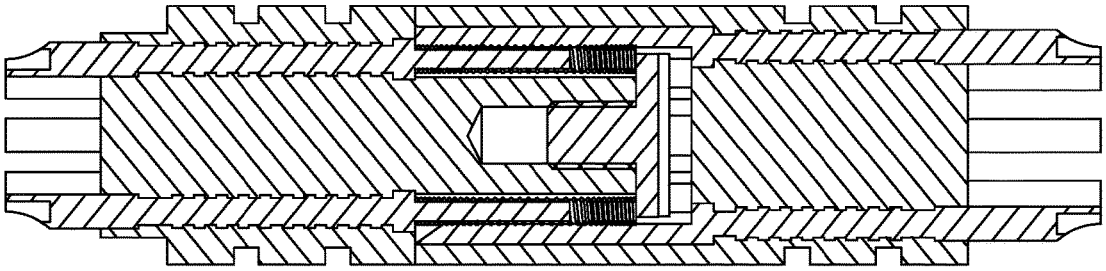
FIG. 3 shows a structural representation after the plug of FIG. 1 is fit with the socket of FIG. 2.
Figure 4:
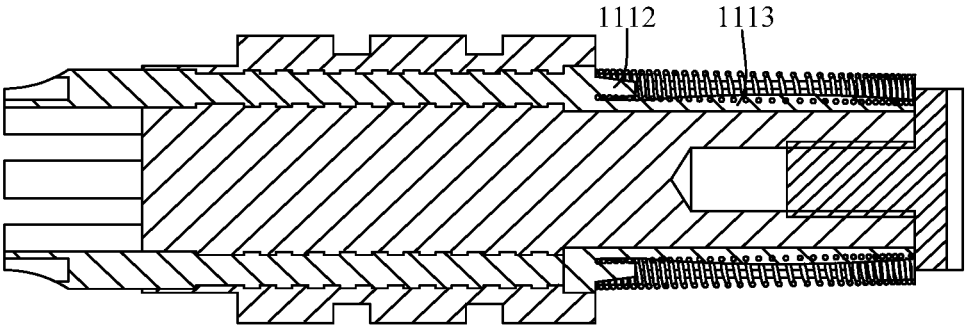
FIG. 4 is a structural representation of another plug according to one embodiment of the invention.
Figure 5:
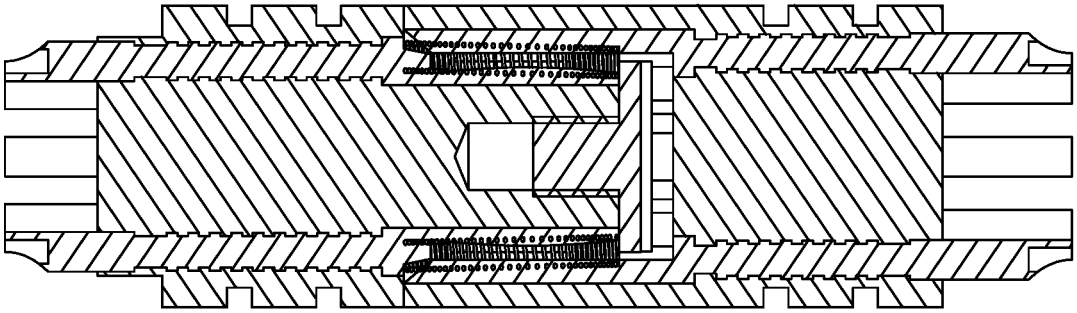
FIG. 5 shows a structural representation after the plug of FIG. 4 is fit with the socket of FIG. 2.

Referring to FIGS. 1, 2 and 3, one embodiment of the invention provides an electrical connector. The electrical connector as provided includes a socket 12 and a plug 11, and the electrical connection of the lines connected therewith respectively can be realized by the fit of the socket 12 and the plug 11. In the electrical connector according to the embodiment of the invention, a jack 123 is set on the socket 12, a socket pin 122 is set in the jack 123, and the plug 11 is set with a plug pin 111 that has a one-to-one correspondence with the socket pin 122. The socket pin 122 is an electricity-conducting part in the socket 12, and the plug pin 111 is an electricity-conducting part in plug 11. During operation, the connection of the socket pin 122 and the plug pin 111 can realize the fit of the socket 12 and the plug 11.

The plug 11 has an insertion part 113 that is in insertion fit with the jack 123, the insertion of the insertion part 113 into the jack 123 may realize the fitting of the socket 12 and the plug 11. In order to better realize the fitting of the insertion part 113 and the jack 123, the end part of the above jack 123 has a coniform flaring. Of course, the diameter of the insertion part 113 is smaller than the diameter of the main body of the plug 11; and in this case, a stepped face can be formed between the insertion part 113 and the main body of the plug 11, which functions as a stop face for the fitting of the insertion part 113 and the jack 123.

In the embodiment of the invention, the insertion part 113 is set with a first groove 1131 that extends along its insertion direction. The plug pin 111 has a one-to-one correspondence with the first groove 1131, and the plug pin 111 has an exposed part that is exposed in the first groove 1131, and other parts of the plug pin 111 are buried in the plug 11. The electrical connector according to the embodiment of the invention further includes a first compression spring 14, which has a one-to-one correspondence with the first groove 1131, and the two ends of the first compression spring 14 respectively abut against the inner wall of the two ends of the first groove 1131, that is, the first compression spring 14 is in a compressed state. The first compression spring 14 is detachably mounted on and contacts the exposed part in the corresponding first groove 1131. The socket pin 122 contacts the corresponding first compression spring 14 as the insertion part 113 of the plug 11 becomes in insertion fit with the jack 123. Usually, in order to make the first compression spring 14 be able to contact the socket pin 122, in the embodiment of the invention, the outer diameter of the first compression spring 14 is slightly greater than the depth of the insertion part 113. Of course, in order to ensure the insertion fit between the insertion part 113 and the jack 123, the first compression spring 14 has a small rigidity, which is easy for the first compression spring 14 to deform.

During the assembling of the electrical connector according to the embodiment of the invention, the first compression spring 14 is mounted, in a one-to-one correspondence, on the exposed part of the plug pin 111 that is located in the first groove 1131, and the two ends of the first compression spring 14 respectively abut against the inner wall of the two ends of the first groove 1131, thus the first compression spring 14 will be in a compressed state. The insertion part 113 of the plug 11 is inserted into the jack 123 of the socket 12, and the socket pin 122 contacts the corresponding first compression spring 14 as the insertion part 113 of the plug 11 becomes in insertion fit with the jack 123. It may be known from the above description that, the socket pin 122 has a one-to-one correspondence with the plug pin 111, and the first compression spring 14 has a one-to-one correspondence with the plug pin 111 and contacts the plug pin 111. Therefore, the socket pin 122 contacts the corresponding first compression spring 14 as the insertion part 113 of the plug 11 becomes in insertion fit with the jack 123, thereby the socket pin 122 can be indirectly connected with the corresponding plug pin 111 via the first compression spring 14.

It may be known from the above description that, the socket pin 122 and the plug pin 111 are electrically connected via the first compression spring 14. When the first compression spring 14 is abrased seriously, it may be directly removed from the exposed part and then replaced, and thus the operation is simple. Of course, during the whole replacement process, no additional process (for example, soldering) is required, and it does not need to replace the whole plug pin 111, thus the cost can be lowered.

Referring again to FIGS. 1 and 3, in one specific implementation of the invention, the exposed part may be a bar-shaped body 1111. Preferably, the bar-shaped body 1111 may be a bar-shaped body 1111 with a circular cross section. The first compression spring 14 is sleeved on the bar-shaped body 1111. After the socket 12 is fit with the plug 11, the socket pin 122 contacts the bar-shaped body 1111 indirectly via the first compression spring 14, thereby the object of connecting the plug pin 111 can be attained. The above bar-shaped body 1111 not only functions to support the first compression spring 14, but also can have more contact points, due to its long length, with the first compression spring 14 when it is in a deformed state, thereby the contact stability can be improved. More preferably, the exposed part at least extends over the midpoint of the first groove 1131 in the length direction.

The above specific implementation may alleviate the problem of contact stability to a certain degree, but the problem of stability still exists. This is mainly because that the first compression spring 14 is sleeved on the bar-shaped body 1111 and the inner diameter of the first compression spring 14 is slightly greater than the external dimension of the bar-shaped body 1111 so as to meet the mounting requirements. Therefore, the contact between the first compression spring 14 and the bar-shaped body 1111 depends on the deformation amount of the first compression spring 14. In order to solve this problem, another embodiment of the invention is provided, referring to FIGS. 4 and 5. Specifically, the exposed part includes a locating part 1112 and a supporting part 1113, the first compression spring 14 is sleeved on the locating part 1112, and the supporting part 1113 is connected with the locating part 1112 and located between the first compression spring 14 and the groove base of the first groove 1131. In this case, the supporting part 1113 functions to support the first compression spring 14, and the locating part 1112 functions to locate the first compression spring 14. For easily mounting the first compression spring 14, the above locating part 1112 has a coniform structure. When the socket 12 is in insertion fit with the plug 11, the first compression spring 14 contacts the locating part 1112 and the supporting part 1113, thereby it functions to indirectly connect the plug pin 111 and the socket pin 122. More preferably, the supporting part 1113 and the locating part 1112 have a one-piece structure. The first compression spring 14 is in a compressed state. In order to make the deformation toward a direction clinging to the socket pin 122, in a more preferred solution, the thickness of the middle part of the supporting part 1113 according to the embodiment of the invention is large, and the thickness of the two ends is small, thus the thickness of the supporting part 1113 decreases from the middle part to the two ends gradually.

Figure 6:
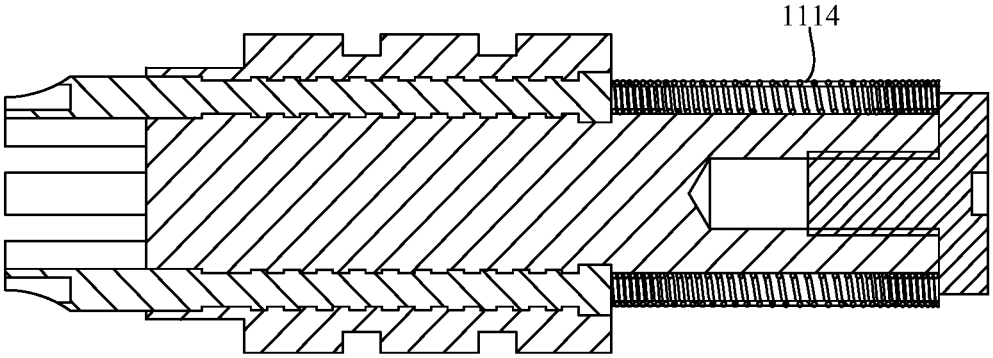
FIG. 6 is a structural representation of another plug according to one embodiment of the invention.
Figure 7:
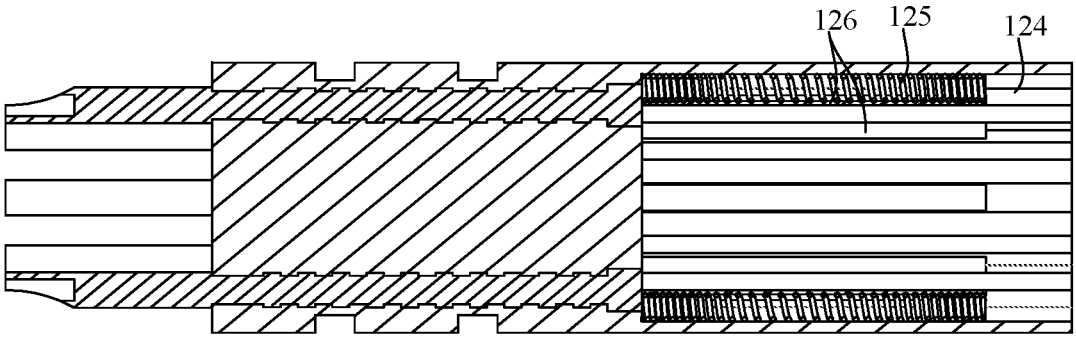
FIG. 7 is a structural representation of another socket according to one embodiment of the invention.
Figure 8:
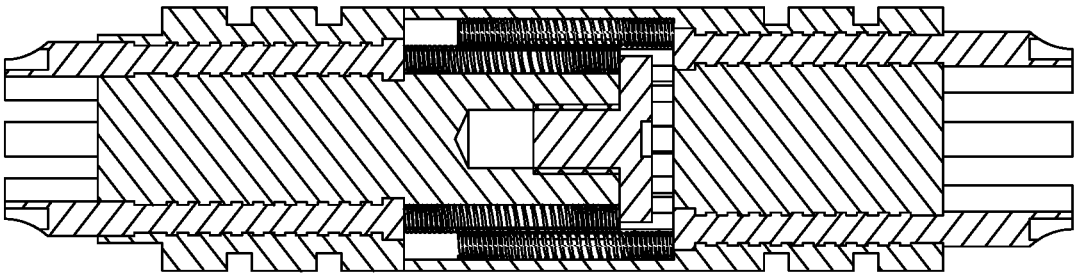
FIG. 8 shows a structural representation after the plug of FIG. 6 is fit with the socket of FIG. 7.

In the exposed part provided above, the exposed part includes a supporting part 1113 and a locating part 1112, which will cause the structure of the whole plug pin 111 to be complex and thus cause the manufacture difficulty to increase. Therefore, one embodiment of the invention further provides an exposed part with a specific structure. Referring to FIGS. 6, 7 and 8, specifically, the exposed part is a first supporting plate 1114 that extends along the length direction of the first groove 1131, the first compression spring 14 is sleeved on the first supporting plate 1114, and the first supporting plate 1114 is located on top of the first groove 1131. More preferably, the socket 12 has a second groove 124 that has a one-to-one correspondence with the first groove 1131, and the socket pin 122 includes a second supporting plate 125 that extends along the length direction of the second groove 124 and a second compression spring 126 that is sleeved on the second supporting plate 125, wherein the second compression spring 126 is adapted to contact the corresponding first compression spring 14 as the jack 123 becomes in insertion fit with the insertion part 113 of the plug 11. In this case, the contact between the first compression spring 14 and the second compression spring 126 indirectly functions to connect the socket pin 122 and the plug pin 111. When the first compression spring 14 and the second compression spring 126 are abrased, they both can be replaced individually, so that it may be avoided to replace the whole socket pin 122 and the whole plug pin 111, thereby the replacement cost can be lowered. In the current electrical connector, the plug pin 111 and the socket pin 122 are both integrated with the main body via ceramic soldering, etc. (referring to FIGS. 1 and 2, a part of the socket pin 122 is buried in the socket ceramic basal body 121, and a part of the plug pin 111 is buried in the plug ceramic basal body 112). Therefore, by the above electrical connector, the replacement of pins can be avoided, and the operational complexity caused by pin replacement can be well lowered.

As described above, in the current electrical connector, the plug pin 111 is integrated with a part of the plug ceramic basal body 112 via ceramic soldering, etc. In a more preferred solution, the plug pin 111 is buried in the plug 11, and the part that is connected with the exposed part is a thickened section 1115, the diameter of thickened section 1115 is greater than the diameter of the exposed section, and the end face of the thickened section 1115 functions as the inner wall of one end of the first groove 1131. In this case, the end part of the first compression spring 14 may abut against the inner wall of the thickened section 1115, thereby the contact stability between the first compression spring 14 and the plug pin 111 can be improved.

In one embodiment of the invention, the first groove 1131 may be a closed groove directly opened on the insertion part 113; and in this case, a gap needs to be kept between the part at which the exposed part and the first compression spring 14 are located and fit and the inner wall of the end part of the first groove 1131, thereby realizing the mounting of the first compression spring 14. However, in this case, it is inconvenient to mount the first compression spring 14. In order to solve this problem, one embodiment of the invention provides another implementation mode. Specifically, the insertion part 113 is set with a half-opened groove that extends along the insertion direction, the groove opening of the half-opened groove is located on the insertion end of the insertion part 113, and the end part of the insertion part 113 is set with a screw 13, the screw 13 is in thread fit with the insertion part 113, and the screw cap 131 of the screw 13 is fit with the groove opening in the manner of blocking the groove opening to form the first groove 1131. During the mounting of the first compression spring 14, it only needs to unscrew the screw 13, then remove the first compression spring 14 through the groove opening, and screw on the screw 13 after a new first compression spring 14 is mounted.

In the electrical connector according to one embodiment of the invention, the plug 11 may have a plurality of plug pins 111, and the corresponding socket 12 may also have a plurality of socket pin 122, thus multiline connection can be realized by the plurality of plug pins 111 and the plurality of socket pins 122. Therefore, the insertion part 113 may be a hexagonal prism or an octagonal prism, and a first groove 1131 may be set on each prismatic plane. Of course, the jack 123 on the socket 12 also needs to have an adaptive structure such as hexagonal hole or octagonal hole, etc. In order to make the product have a better foolproof function, the areas of the prismatic planes on the above insertion part 113 are not equal to each other, and the areas of the inner walls in the corresponding jack 123, which correspond to the prismatic planes of the insertion part 113, are not equal to each other, too.

Usually, the socket pin 122 is set on the socket 12 via ceramic injection moulding, and the plug pin 111 is also set on the plug 11 via ceramic injection moulding. For better combining the socket pin 122 and the plug pin 111 with the ceramic, the part of the above socket pin 122 that is buried in the socket 12 and the part of the plug pin 111 that is buried in the plug 11 both have threads. However, minor gaps may exist between the threads and the injection-moulded ceramic, which may cause an ambient liquid matter to enter the electrical connector. Taking the petroleum drilling as an example, the conditions in the drilling well are very bad, and the liquid petroleum may enter into the electrical connector through the gaps as mentioned above, and thus the connection stability of the electrical connector may be influenced. In order to solve this problem, in the electrical connector according to one embodiment of the invention, the part of the socket pin 122 that is buried in the socket 12 and the part of the plug pin 111 that is buried in the plug 11 both have multiple sections of threads that are distributed discretely. The multiple sections of threads that are distributed discretely may ensure the combination stability of the plug pin and the socket pin 122 with the ceramic, and at the same time, it can be avoided that a continuous gap is formed from the outside of the electrical connector to the inside of the electrical connector, thereby a blocking function may be realized, and it can be avoid that an external liquid matter enters into the electrical connector.

Based on the electrical connector according to the embodiments of the invention, one embodiment of the invention further provides a drilling system, which has an electrical connector according to any one of the above embodiments of the invention.

The embodiments in this specification are described in a stepped mode, and reference may be made to each other for the same or similar parts between the embodiments. Each embodiment emphasizes a different part from other embodiments.

The above embodiments of the invention will not limit the protection scope of the invention. All modifications, equivalent substitutions and improvements made within the spirit and principles of the invention will fall into the protection scope of the invention.

What is claimed is:

1. An electrical connector, which comprises a socket (12) and a plug (11); a jack (123) is set on the socket (12), and a socket pin (122) is set in the jack (123); the plug (11) is set with a plug pin (111) that has a one-to-one correspondence with the socket pin (122); wherein the plug (11) has an insertion part (113) that is in insertion fit with the jack (123), and the end part of the insertion part (113) is set with a first groove (1131) that extends along its insertion direction; the plug pin (111) has a one-to-one correspondence with the first groove (1131) and has an exposed part that is exposed in the first groove (1131); the electrical connector further comprises a first compression spring (14), which has a one-to-one correspondence with the first groove (1131), the two ends of the first compression spring (14) respectively abut against the inner wall of the two ends of the first groove (1131); the first compression spring (14) is detachably mounted on and contacts the exposed part in the corresponding first groove (1131); the socket pin (122) contacts the corresponding first compression spring (14) as the jack (123) becomes in insertion fit with the insertion part (113) of the plug (11).

2. The electrical connector according to claim 1, wherein, the exposed part is a bar-shaped body (1111) with a circular cross section, and the bar-shaped body (1111) at least extends over the midpoint of the first groove (1131) in the length direction, and the first compression spring (14) is sleeved on the bar-shaped body (1111).

3. The electrical connector according to claim 1, wherein, the exposed part comprises a locating part (1112) and a supporting part (1113), the first compression spring (14) is sleeved on the locating part (1112), the supporting part (1113) and the locating part (1112) have a one-piece structure and are located between the first compression spring (14) and the groove base of the first groove (1131).

4. The electrical connector according to claim 1, wherein, the exposed part is a first supporting plate (1114) that extends along the length direction of the first groove (1131), and the first compression spring (14) is sleeved on the first supporting plate (1114);

the socket (12) has a second groove (124) that has a one-to-one correspondence with the first groove (1131), and the socket pin (122) comprises a second supporting plate (125) that extends along the length direction of the second groove (124) and a second compression spring (126) that is sleeved on the second supporting plate (125); the second compression spring (126) is adapted to contact the corresponding first compression spring (14) as the jack (123) becomes in insertion fit with the insertion part (113) of the plug (11).

5. The electrical connector according to claim 2, wherein, the plug pin (111) is buried in the plug (11), and the part that is connected with the exposed part is a thickened section (1115), the diameter of the thickened section being greater than that of the exposed part.

6. The electrical connector according to claim 1, wherein, the insertion part (113) is set with a half-opened groove that extends along the insertion direction, the groove opening of the half-opened groove is located on the insertion end of the insertion part (113), and the end part of the insertion part (113) is set with a screw (13) in thread fit with the insertion part (113), and a screw cap (131) of the screw (13) is fit with the groove opening in the manner of blocking the groove opening to form the first groove (1131).

7. The electrical connector according to claim 1, wherein, the insertion part (113) is a hexagonal prism or an octagonal prism, and each prismatic plane of the prism is set with the first groove (1131).

8. The electrical connector according to claim 3, wherein, the areas of the respective prismatic planes of the insertion part (113) are not equal to each other, and the areas of the inner walls in the jack (123) corresponding to the respective prismatic planes of the insertion part (113) are not equal to each other.

9. The electrical connector according to claim 1, wherein, the socket pin (122) is set on the socket (12) via ceramic injection moulding, the plug pin (111) is set on the plug (11) via ceramic injection moulding, and the part of the socket pin (122) that is buried in the socket (12) and the part of the plug pin (111) that is buried in the plug (11) both have multiple sections of threads that are isolated from each other.

10. A drilling system, which comprises the electrical connector according to claim 1.

* * * * *